US006050199A

United States Patent [19]

Anderson et al.

[11] Patent Number: 6,050,199

[45] Date of Patent: Apr. 18, 2000

[54] HATCH COVER SEALING DEVICE

[75] Inventors: John D. Anderson; Walter J. Peach, Jr., both of Aurora, Ill.

[73] Assignee: Zeftek, Inc., Montgomery, Ill.

[21] Appl. No.: 09/049,769

[22] Filed: Mar. 27, 1998

[51] Int. Cl.[7] ..... B61D 51/00

[52] U.S. Cl. ..... 105/377.07; 105/377.08; 220/378; 277/637

[58] Field of Search ..... 105/377.05, 377.06, 105/377.07, 377.08; 220/378; 277/628, 634, 637, 640, 641, 642, 643

[56] References Cited

U.S. PATENT DOCUMENTS

| | | | |
|---|---|---|---|
| 2,239,269 | 4/1941 | Lundvall . | |
| 2,324,356 | 7/1943 | Brown . | |
| 2,647,473 | 8/1953 | Lunde . | |
| 2,663,268 | 12/1953 | Ahnell . | |
| 2,745,362 | 5/1956 | Lunde . | |
| 3,312,149 | 4/1967 | Fleckenstein et al. . | |
| 3,701,452 | 10/1972 | Tonn . | |
| 4,114,668 | 9/1978 | Hickey . | |
| 4,248,160 | 2/1981 | Carney, Jr. et al. . | |
| 4,461,219 | 7/1984 | Bateson . | |
| 4,570,816 | 2/1986 | Ferris et al. . | |
| 4,594,949 | 6/1986 | Kleykamp | 105/377.08 |
| 4,635,979 | 1/1987 | Blume . | |
| 4,655,365 | 4/1987 | Miller . | |
| 4,690,070 | 9/1987 | Miller . | |
| 4,699,293 | 10/1987 | Duchrow . | |
| 4,738,905 | 4/1988 | Collins . | |
| 4,819,830 | 4/1989 | Schultz . | |
| 4,889,056 | 12/1989 | Stewart . | |
| 4,944,233 | 7/1990 | Dugge et al. . | |
| 5,064,089 | 11/1991 | Schultz . | |
| 5,622,117 | 4/1997 | Burian et al. . | |
| 5,644,990 | 7/1997 | Seitz . | |
| 5,813,352 | 9/1998 | Bramlett et al. . | |

FOREIGN PATENT DOCUMENTS

| | | |
|---|---|---|
| 278139 | 7/1926 | United Kingdom . |

*Primary Examiner*—Mark T. Le
*Attorney, Agent, or Firm*—Lloyd L. Zickert

[57] ABSTRACT

A sealing device for a hatch cover closing a hatch on a railcar, wherein the hatch cover includes a pocket for receiving a gasket, and the pocket includes projections mating with recesses on the gasket or projections on the gasket mating with recesses in the pocket for removably retaining the gasket in the pocket.

10 Claims, 2 Drawing Sheets

HATCH COVER SEALING DEVICE

This invention relates in general to a hatch cover for closing a hatch on a railroad hopper car, and more particularly to the sealing means for a hatch cover that produces a substantially airtight connection between the hatch and the cover and permits easy cleaning and/or removal of the sealing means.

BACKGROUND OF THE INVENTION

Railroad hopper cars that carry bulk particulate materials or commodity, such as grain, food products, plastic pellets, powder, or other materials, have long been in use. Hopper cars generally have one or more compartments for storing and transporting these materials. Each compartment has at least one hatch in the roof of the car at the top of the compartment for loading materials into the compartment and at least one outlet at the bottom of the compartment for unloading of the materials. A hatch cover is provided for each hatch to close the compartment after loading and thereby prevent foreign matter and moisture from entering the compartment and contaminating the stored materials during transit.

Heretofore, it has been known to use a gasket to seal the connection between the hatch cover and the hatch. Generally, the gasket is adhesively attached to the hatch cover. Use of an adhesive, however, prohibits or hinders the removal of the gasket when the gasket becomes dirty or worn.

It has also been known to provide a hatch cover with a removable gasket as in U.S. Pat. No. 2,745,362 and U.S. Pat. No. 5,622,117. Both patents disclose a non-adhesive retention means for supporting the gasket on the cover. The '362 patent shows annular ribs extending from opposed flanges and underlying the edges of the gasket, while the '117 patent uses clips that extend from the flanges and hold the gasket in place. One problem with the use of ribs or clips as shown in the '362 and '117 patents is that contaminants from the outside air and contents within the cars can accumulate between the clips and the gasket, thereby deteriorating the sealant quality of the gasket. Furthermore, cleaning of the hatch-engaging face of the gasket requires removal of the gasket from the cover for cleaning under the ribs or clips. Accordingly, there is a need for a gasket to be used in hatch covers that eliminates the problems associated with using adhesives, with deterioration of the sealant qualities, and with cleaning the gasket.

SUMMARY OF THE INVENTION

The present invention overcomes the above problems by providing an improved sealing means for a cover that may be easily removed from the cover and which has the entire bottom face or hatch-engaging face exposed for easy cleaning when the cover is in open position, and which eliminates areas on the hatch-engaging face that could collect contaminants and/or materials carried in the hopper car or outside contaminants.

The sealing means of the present invention includes a hatch cover that has a peripheral pocket, defined by an inner and outer flange, and a uniquely shaped gasket removably received in the pocket. The hatch cover is designed so that the pocket and gasket aligns with the flange of the hatch coaming. A plurality of nodes, detents or projections protrude from the facing surfaces of both the inner and outer flanges of the hatch cover. The nodes, which are integrally molded to the flanges defining the pocket, protrude out from the flanges to engage recesses in the sides of the unique gasket when inserted into the pocket. Alternatively, the projections or nodes can be formed on the gasket to mate with recesses in the flanges.

The embodiment of the gasket which includes concave sections or recessed areas on opposing sidewalls receive the nodes and removably secure the gasket within the pocket of the cover. Similarly, the embodiment of the gasket having nodes or projections is received within the pocket where the nodes engage recesses on the flanges to secure the gasket in the pocket. In use, the hatch cover fits over the hatch such that the gasket will coact with the flange of the hatch coaming and seal the cover to the hatch. The gasket may be easily removed from the pocket of the hatch cover and replaced if necessary with a new gasket. Furthermore, to enhance the sealing qualities of the gasket the present invention also allows the entire engaging face of the gasket to be cleaned without having to remove the gasket from the pocket. Moreover, the gasket may be symmetrically shaped so that it can be reversed in the pocket to present a new face for engaging the hatch.

In a further alternative embodiment, the hatch cover has at least one continuous rib located on either of the inner or the outer flange. The continuous rib may then fit within the concave section or recessed area of the gasket to secure the gasket within the pocket of the hatch cover.

DESCRIPTION OF THE INVENTION

Figure 1:
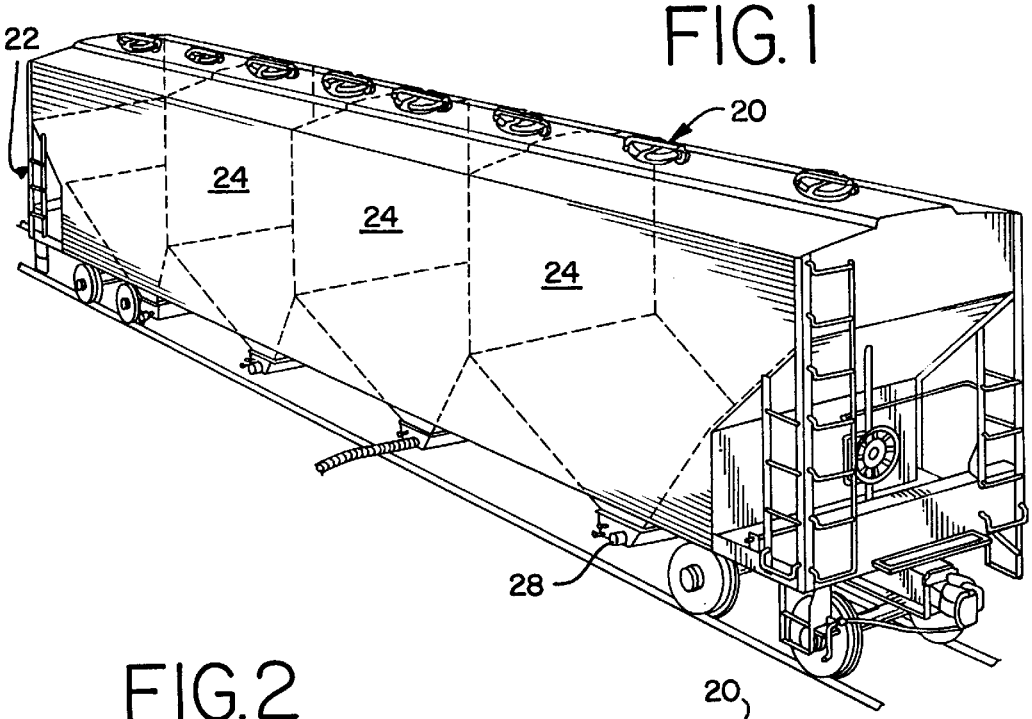
FIG. 1 is a perspective view of a railroad hopper car illustrating a plurality of hatch covers of the present invention mounted on the hatches in the roof of the hopper car.
Figure 2:
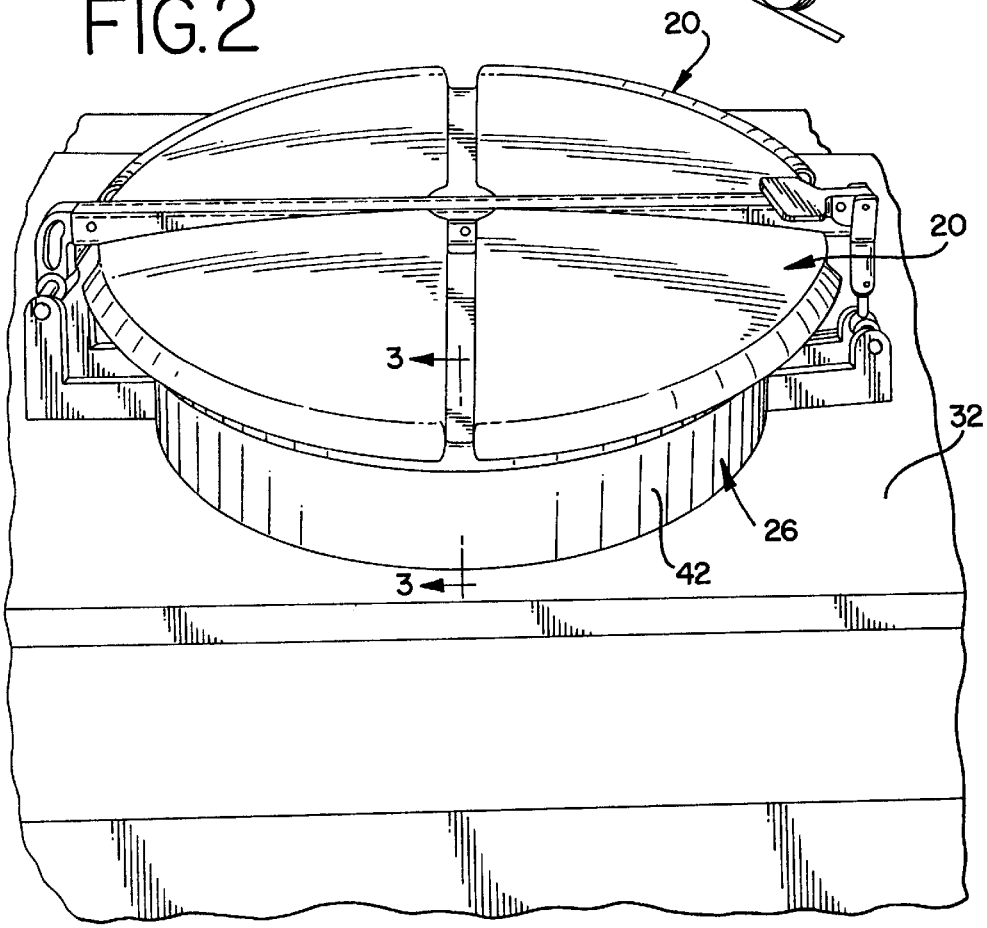
FIG. 2 is an enlarged perspective view of the hatch cover of the present invention mounted on the hatch of a hopper car.

Referring now to the drawings, and particularly to FIGS. 1 and 2, a hatch cover having the sealing means of the present invention, and generally indicated by the numeral 20, is shown mounted on the hatch of a conventional railroad hopper car 22 that may be loaded with particulate materials. The illustrated hatch cover 20 is of the vented type, although it should be appreciated the sealing means of the invention is also applicable to a non-vented cover, as the sealing means defines a seal between the hatch and hatch cover to prevent the loss of material from the compartment and the entry of contaminants.

The hopper car 22 includes a plurality of compartments 24, each having one or more hatches or loading nozzles 26 at the car roof and top of the compartment and a discharge or outlet 28 at the bottom of the compartment. The compartments 24 receive and store materials being transported by the car. The hatches are used for loading materials into the compartments and for venting the compartments during the unloading process and during transit. While the hopper car illustrated in FIG. 1 has one outlet and two hatches, it should be appreciated that the number of outlets and hatches could vary and that the hatch cover of the present invention could be mounted on any number of hatches. It also should be appreciated that while the hatch and hatch cover illustrated and described below are circular in shape, the sealing means of the present invention may be used with a hatch and hatch cover of various shapes. For example, the hatch and cover may be rectangular in shape, where several covers would be provided for closing several hatches on a car. Additionally, the hatch could be trough-shaped, and closable by an elongated cover that may additionally have a plurality of smaller individual covers. Common to all hatches would be a peripheral pocket for receiving a gasket.

Figure 3:
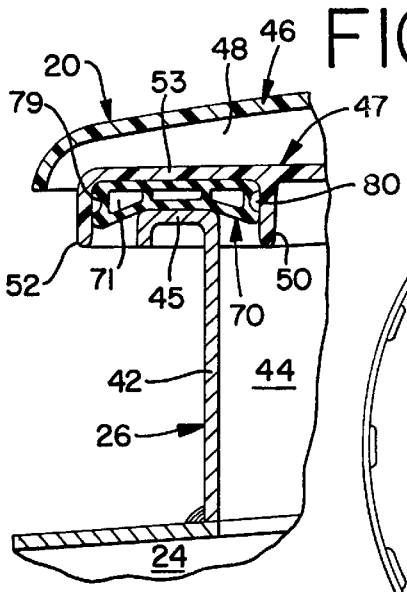
FIG. 3 is an enlarged fragmentary cross-sectional view of the hatch cover and hatch in the area of the sealing means of the present invention and taken substantially along line 3—3 of FIG. 2.

Each hatch includes an annular coaming 42 extending upwardly from the roof of the car, as illustrated in FIGS. 2 and 3. The coaming 42 defines a circular hatch opening 44 for the compartment. An annular flange 45 extends around the top of the coaming 42, although not all hatches have a flange. The hatch cover of the present invention includes a sealing means to form a substantially airtight seal between the hatch and hatch cover, and more particularly between the cover and the annular flange 45 or coaming 42 of the hatch.

Figure 4:
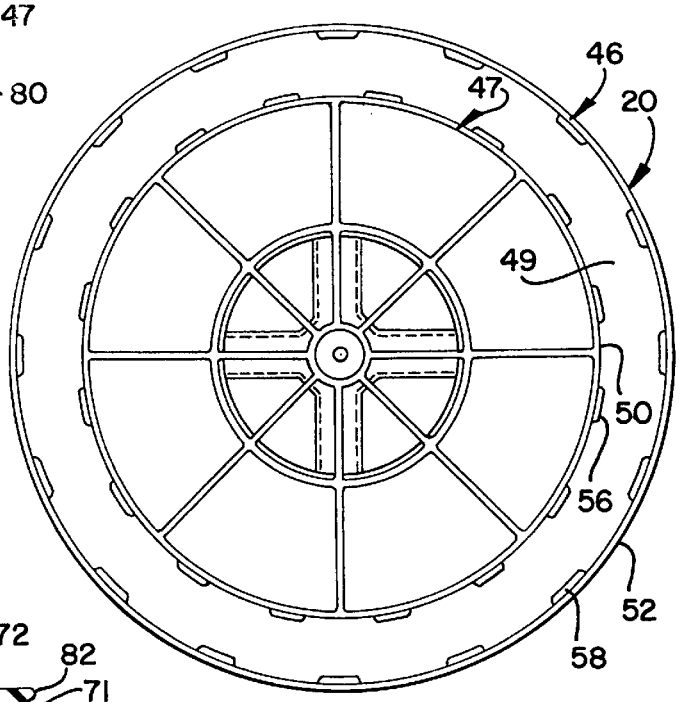
FIG. 4 is a bottom plan view of the hatch cover of the present invention.

The sealing means of the present invention may work with any hatch cover that contains a gasket receiving pocket. An example of one type of hatch cover is shown in FIGS. 2 to 4, wherein the hatch cover is circular in shape for fitting on a circular hatch. It will be appreciated that polygonally shaped hatches using a polygonally shaped hatch cover could be provided with the sealing means of the invention. As seen in FIGS. 3 and 4, the hatch cover 20 includes a body member having interconnected upper and lower panels 46 and 47 defining an airflow channel 48 therebetween, thereby venting the compartment. The lower panel is formed to define a pocket 49 at the periphery which includes substantially parallel extending inner and outer flanges 50 and 52, and a top wall 53. The flanges 50 and 52 extend downwardly from the top wall 53. When the hatch cover 20 is placed on the hatch 26 to close the hatch, the pocket 49 defined by the inner and outer flanges 50 and 52 straddles the annular flange 45 of the coaming 42.

The outer surface of the inner flange 50 and the inner surface of the outer flange 52 each include a series of nodes, detents or projections 56 and 58 in circumferentially spaced relation around the flanges, as seen in FIG. 4. The nodes 56 and 58 may be of any suitable size, but it is preferred that the nodes 56 and 58 are button-like in form with a semi-circular or rounded surface to facilitate mounting of a gasket as described below. Preferably, the nodes are somewhat elongated although they may be spherically shaped if desired. Moreover, it may be appreciated that the inner or the outer flange may have a continuous rib or raised portion around its respective circumference instead of spaced-apart nodes.

Figure 5:
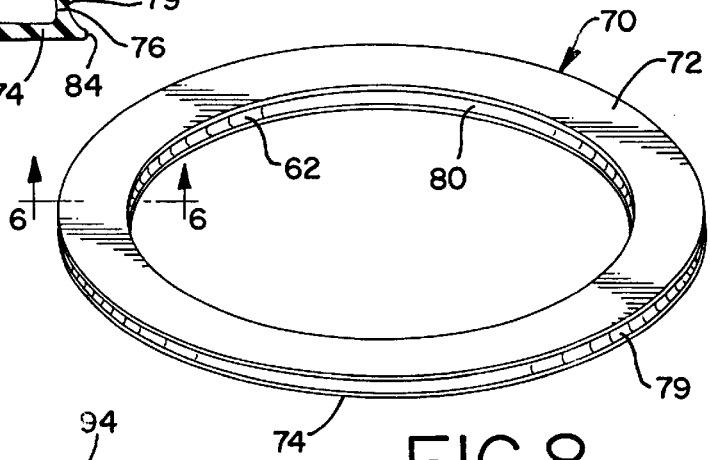
FIG. 5 is a perspective view of the gasket or seal of the present invention.

A gasket 70 is received in the cover pocket 49 and preferably formed with a plurality of generally rectangular cross-sectioned, atmospheric, air-filled lumens 71 or compartments running annularly through the gasket 70. Referring to FIG. 5, the gasket 70 is annular or ring-shaped for the circular hatch cover, and it will be understood that it will be sized to fit in the annular pocket 49 of the cover 20 and be retained by nodes 56 and 58.

Figure 6:
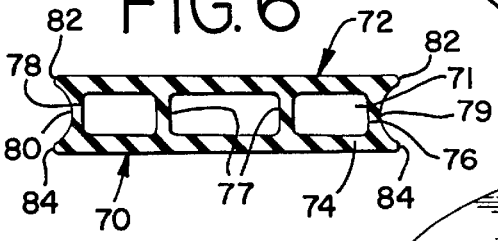
FIG. 6 is an enlarged cross-sectional view through the gasket of the invention and taken substantially along line 6—6 of FIG. 5.

As seen in FIGS. 3 and 6, the gasket 70 includes top and bottom substantially parallel walls 72 and 74, substantially parallel opposed side walls 76 and 78, and intermediate walls 77. The side walls have concave faces 79 and 80, respectively, and upper and lower rounded corners or upper annular ribs 82 and lower annular ribs 84. The intermediate walls or partitions reinforce the gasket. The opposing side walls' concave faces 79 and 80 are sized to matingly receive the nodes 56 and 58 and retain the gasket 70 within the pocket 49. Although concave faces 79 and 80 are illustrated, other cavity or face shapes, such as polygonal, may also be used with the present invention.

In use, the gasket 70 is inserted into the pocket 49 such that when the cover closes the hatch, the gasket engages and forms a substantially airtight seal between the cover 20 and the hatch flange 45 of the coaming 42, as illustrated in FIG. 3. Although the gasket 70 could be of any suitable natural or synthetic resilient material, it is preferably made from a white EPDM rubber having a Shore durometer hardness rating on the A scale of approximately seventy. Preferably, the gasket is made from unvulcanized extruded stock placed on a mandrel and cured, cut into lengths, and then connecting the ends together by adhesive to form a continuous gasket.

To install the gasket 70 within the pocket 49 of the hatch 20, the gasket 70 is flexed so that the upper gasket ribs 82 may be inserted past the nodes 56 and 58. Once the top wall 72 of the gasket is beyond the nodes 56 and 58, the gasket 70 is retained in the pocket. While secured in the pocket 49, the entire bottom face of the gasket 74 is exposed to facilitate easy cleaning of the gasket 70, while the upper face bottoms against the top wall 53. The gasket 70 may be removed from the pocket 60 by flexing the gasket 70 until the upper ribs of the gasket clear the tip of the nodes 56 and 58. The gasket 70 may then be reversed and reinserted into the pocket 49, or replaced in its entirety. Further, as seen in FIG. 3, the gasket ribs 82 and 84 seal against the respective flange when the gasket is deformed on the hatch to provide a double seal against passage of material or contaminants.

Figure 7:
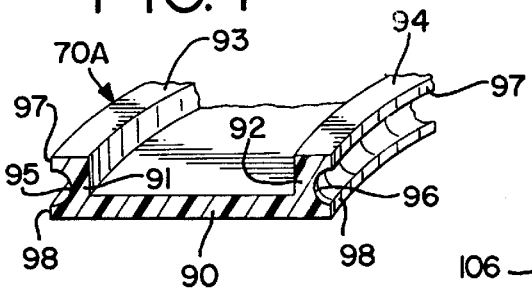
FIG. 7 is an enlarged cross-sectional view of a modification of the invention, where the nodes are formed on the gasket, and the recesses are formed on the walls of the flanges.
Figure 8:
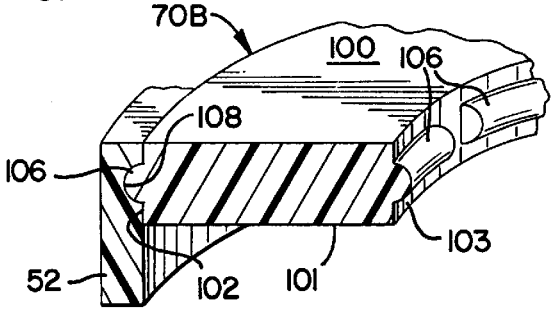
FIG. 8 is an enlarged cross-sectional somewhat diagrammatic view of a further modification of the invention, where the gasket is U-shaped.

Further modifications of the invention are shown in FIGS. 7 and 8, wherein the gasket shape takes other forms.

Referring to FIG. 7, the modified gasket, generally indicated as 70A, is generally U-shaped, and includes a bottom wall 90, and opposed upstanding walls 91 and 92, which include upper end surfaces 93 and 94, respectively, that bottom in the hatch cover pocket of a hatch cover. The opposing side walls 91 and 92 are provided with outer faces having oppositely opening recesses 95 and 96, respectively, and upper and lower lips or ribs 97 and 98. The recesses are concavely formed although they could take other shapes. This gasket is formed to be retained by a pocket where the flanges have nodes or projections as shown in the cover of FIGS. 3 and 4. Further, a continuous projection or rib could be formed on the flanges for mating with the recesses in the side walls of the gasket 70A. Thus, this gasket can be used in place of the gasket 70. However, gasket 70A must be oriented in the hatch cover pocket so that the wall 90 is downward and can engage the hatch.

Referring now to FIG. 8, a further modified gasket, generally indicated as 70B, differs from the other embodiments in that the nodes or projections are formed on the gasket for mating in sockets or grooves formed in the flanges of the hatch cover pocket. The gasket 70B is solid and the cross-sectional shape is generally rectangular with nodes or projections on the side walls. The gasket includes upper and lower surfaces or walls 100 and 101, opposed side surfaces or walls 102 and 103, and a plurality of spaced apart nodes or projections 106 on the opposed walls 102 and 103. The gasket nodes or projections are preferably spaced equally apart, and may or may not be oppositely aligned. Moreover, a continuous rib or projection may be formed in place of a plurality of nodes. As above noted, the nodes may have a rounded shape as shown or be polygonally shaped. In this embodiment, the flanges of the hatch cover pocket have continuous recesses or grooves 108 into which the nodes or projections of the gasket are received to retain the gasket in place. Only flange 52 of the pocket is shown, but it is understood both flanges would include grooves. This gasket may be placed in the pocket without regard to orientation and may later be reversed.

The gaskets 70A and 70B are preferably injection molded from a suitable synthetic or natural resilient material such as an EPDM rubber that is FDA approved. The material for the gasket 70B is preferably softer than what would be used for gaskets 70 and 70A.

From the foregoing, it will be appreciated the present invention facilitates the sealing function between a hatch and hatch cover, where the gasket may be easily installed and removed from the pocket of a cover by virtue of a retention means that includes one of a male or female means on the pocket engaging one of a female or male means on the gasket.

It will be understood that modifications and variations may be effected without departing from the scope of the novel concepts of the present invention, but it is understood that this application is to be limited only by the scope of the appended claims.

The invention is hereby claimed as follows:

1. In a hatch cover for closing a hatch of a railroad hopper car compartment, wherein said hatch includes a generally upstanding coaming, and said hatch cover includes a body member having a peripheral continuous pocket including inner and outer substantially parallel flanges, said inner and outer flanges including a male or female means for retaining, and a continuous sealing means received in the pocket for sealing the cover to the hatch coaming, the improvement being in said sealing means defining a substantially airtight seal between the hatch cover and the coaming, said sealing means comprising:

a continuous gasket having top, bottom and side walls, said side walls having one of a female or male means for retaining to mate with the male or female means on said flanges, said gasket being symmetrically formed with respect to a horizontal plane passing through the side walls of the gasket so that the gasket may be reversibly received in said pocket, whereby said gasket fits within said pocket and is retained in said pocket by one of said male or female means on said flanges engaging complementary female or male means on said gasket.

2. The sealing means of claim 1, wherein said one of the male or female means on said flanges is a projection extending from a flange and said one of the female or male means on said gasket is a recess in a side wall of the gasket.

3. The sealing means of claim 1, wherein said one of the male or female means on said flanges is a recess in a flange and said one of the female or male means on the gasket is a projection matable in the recess of the flange.

4. The hatch cover of claim 1, wherein said male means includes a semi-circular node arrangement and said female means includes a mating concave recess.

5. The hatch cover of claim 4, wherein the male means is on the flanges and the female means is on the gasket side walls.

6. The hatch cover of claim 4, wherein the node arrangement includes a plurality of nodes on each of the flanges, and said mating concave recess includes a continuous recess on each of said gasket side walls.

7. The hatch cover of claim 1, wherein the gasket is annular in shape.

8. The hatch cover of claim 1, wherein the gasket includes at least one endless lumen.

9. The hatch cover of claim 1, wherein the gasket includes a plurality of endless air-filled lumens.

10. A hatch cover for closing a hatch of a railroad hopper car compartment, said hatch including a generally upstanding coaming, said hatch cover including a body member having a peripheral continuous pocket with inner and outer substantially parallel flanges, a continuous sealing means received in the pocket for defining a substantially airtight seal between the hatch cover and the coaming, said inner and outer flanges of said pocket having one of a male or female means for retaining, and said sealing means comprising a continuous gasket having top, bottom and side walls, said side walls having one of a female or male means for retaining to mate with the male or female means on said flanges, said gasket being symmetrically formed with respect to a horizontal plane passing through the side walls of the gasket so that it may be reversibly received in said pocket, whereby said gasket fits within said pocket and is retained in said pocket by one of said male or female means on said flanges engaging complementary female or male means on said gasket.

* * * * *